US007175145B2

(12) United States Patent
Simpson

(10) Patent No.: US 7,175,145 B2
(45) Date of Patent: Feb. 13, 2007

(54) ORNAMENT BASE

(76) Inventor: Fred B. Simpson, 105 N. Side Sq., Huntsville, AL (US) 35801

( * ) Notice: Subject to any disclaimer, the term of this patent is extended or adjusted under 35 U.S.C. 154(b) by 186 days.

(21) Appl. No.: 10/799,969

(22) Filed: Mar. 12, 2004

(65) Prior Publication Data

US 2005/0199771 A1 Sep. 15, 2005

(51) Int. Cl.
*A47B 96/06* (2006.01)
*E04G 5/06* (2006.01)

(52) U.S. Cl. ..... 248/231.81; 248/214

(58) Field of Classification Search ..... 248/229.16, 248/229.26, 228.7, 230.7, 231.81, 214, 235, 248/250, 206.5; 40/658, 649, 656, 1.5, 1.6; 24/499, 500, 507, DIG. 29; 206/562, 563, 206/564, 56, 350, 364, 365
See application file for complete search history.

(56) References Cited

U.S. PATENT DOCUMENTS 2,036,655 A * 4/1936 Storaasli ..... 248/229.13
2,063,924 A * 12/1936 Hanko ..... 248/229.23
2,636,709 A * 4/1953 Haake ..... 248/222.13
3,965,605 A 6/1976 Allen
4,047,109 A 9/1977 Sekiguchi
D256,963 S 9/1980 Harrington
4,361,934 A 12/1982 Darnell
4,538,751 A * 9/1985 Peterson ..... 224/669
D303,333 S 9/1989 Fayerman et al.
4,939,004 A 7/1990 Fuss
5,065,622 A 11/1991 Veenstra
5,071,098 A 12/1991 Aldridge
5,124,903 A * 6/1992 Coviello ..... 362/392
5,527,006 A 6/1996 Stith
D372,990 S 8/1996 Sweeney
5,615,454 A 4/1997 Contarino
D382,906 S 8/1997 Bach et al.
5,722,125 A 3/1998 Vasilopoulos
5,761,843 A * 6/1998 Lynch et al. ..... 43/4.5
D396,309 S 7/1998 Churchville et al.
5,806,459 A 9/1998 Haves
5,848,493 A 12/1998 Gasper
6,073,896 A * 6/2000 McFadden ..... 248/231.81
6,227,388 B1 * 5/2001 Borzelleca ..... 211/88.01
D450,620 S 11/2001 Simpson
D477,790 S * 7/2003 Simpson ..... D11/130

* cited by examiner

*Primary Examiner*—Gwendolyn Baxter
(74) *Attorney, Agent, or Firm*—Lanier Ford Shaver & Payne P.C.; George P. Kobler

(57) ABSTRACT

An apparatus for the display of seasonal ornaments, figurines and decorative items on both generally flat horizontal surfaces and highly irregular generally horizontal projections is provided. An ornament, figurine, or decorative item may be attached to an upper surface of a platform of the present invention. The platform is provided with at least one attachment device for attaching said platform to an irregular generally horizontal surface for the display of the item affixed to its upper surface. Such item may be similarly displayed on a generally flat horizontal surface without the removal of such item from such platform by the use of a base member of the present invention's assembly. Such base member may include a corresponding receptor hole for the attachment device in the upper surface of such base member. The base member may be generally about the same size as the platform to which the item is mounted.

11 Claims, 5 Drawing Sheets

ORNAMENT BASE

BACKGROUND OF THE INVENTION

The present invention generally relates to a support assembly for supporting a decorative ornament during display. More particularly, the present invention relates to a horizontal base and assembly for supporting a decorative ornament. Most particularly, the present invention relates to a shelf assembly for supporting a decorative ornament; such shelf assembly including a generally horizontal shelf or platform and a base member. The horizontal platform has attachment means on its underside allowing for easy attachment to other display venues, including, but not limited to a Christmas tree branch or curtain rod.

Various forms of seasonal and year-round decorations have been designed and used. Most seasonal tree ornaments use S-shaped hooks to suspend the ornament from a branch of said tree. One end of the hook is draped over such branch and the top portion of the ornament is attached to the opposite curved end of the hook. The ornament must be fashioned to accept the hook which may interfere with or limit its ornamental design.

In some cases it may be desirable not to suspend an ornament from its top portion in order to achieve, among other things, an appropriate ornamental design. One means of achieving this objective is disclosed in U.S. Pat. No. 5,071,098 which describes a complex apparatus that attaches to the tree trunk with a VELCRO® strap and projects jointed arms with terminal platforms. The ornament may rest on one or both platforms. The platforms of the '098 invention, however, are fixed to the arms of the apparatus which restricts the location of the ornament(s) within the tree.

Various clips and/or clamps have been described to support ornaments in Christmas trees. U.S. Pat. No. 4,939,004 describes an ornament that adds human features to a Christmas tree. The assembly of the '004 patent comprises a horizontal attachment which attaches to a vertical projection, such as the base or trunk of the tree. U.S. Pat. No. 5,527,006 describes a scissors-like clamp which attaches to a branch. An ornament may then be suspended from the clamp's top portion.

The present invention overcomes such limitations and provides a new and useful apparatus to support an ornament or figurine generally vertically by attachment to a generally horizontal projection. Additionally, the present invention allows for the display of such ornament on a generally horizontal surface, such as a table top or fireplace mantle.

SUMMARY OF THE INVENTION

The present invention recognizes and addresses various of the foregoing limitations and drawbacks concerning the functional display of ornaments both in a manner in which the ornament may be attached to a tree and as displayed on a generally flat surface. The ornamental support base of the present invention may have a top generally flat platform to support an ornament or figurine. Such platform may also have a generally flat bottom surface with an integral magnetic contact means and attachment means attached thereto. The platform may rest on a base that may contain an opposing polarity magnet for easy securement of such platform to said base and a corresponding number of receiving slots for internment of said attachment means. Such base may be used to display an ornament mounted on such platform on any generally horizontal surface, such as a table or fireplace mantle.

To display such a mounted ornament on other irregular horizontal surfaces, such as on a tree branch, the platform may be removed from the base and the attachment means connected to such generally flat bottom surface of the platform may be used to attach the ornament to the irregular surface. The attachment means on the bottom of such removable platform may have jaws with gripping teeth that are biased against each other so as to attach the platform to a tree limb or branch.

It is, therefore, a principle object of the subject invention to provide a new and improved device for the display of seasonal ornaments, figurines and decorative items. More particularly, it is an object of the present invention to provide an apparatus that may easy be used to display such ornaments, figurines and decorative items on an irregularly shaped, generally horizontal projection. In such context, it is still a more particular object of the present invention to provide a device to support seasonal ornaments, figurines or decorative items on a Christmas tree without having to suspend them from a tree branch.

Still further, it is a principle object of this invention to provide a device that supports ornaments, figurines and decorative items. In such context, it is an object of the present invention to provide a cost-effective method for displaying ornaments, figurines or decorative items on a generally flat horizontal surface, such as a table or a fireplace mantle, with an option to display such ornament using the same platform on an irregular generally horizontal projection, such as a tree branch.

Additional objects and advantages of the invention are set forth in, or will be apparent to those of ordinary skill in the art from, the detailed description as follows. Also, it should be further appreciated that modifications and variations to the specifically illustrated and discussed features and materials hereof may be practiced in various embodiments and uses of this invention without departing from the spirit and scope thereof, by virtue of present reference thereto. Such variations may include, but are not limited to, substitutions of the equivalent means, features, and materials for those shown or discussed, and the functional or positional reversal of various parts, features, or the like.

Still further, it is to be understood that different embodiments, as well as different presently preferred embodiments, of this invention, may include various combinations or configurations of presently disclosed features, elements, or their equivalents (including combinations of features or configurations thereof not expressly shown in the figures or stated in the detailed description). These and other features, aspects and advantages of the present invention will become better understood with reference to the following descriptions and appended claims. The accompanying drawings, which are incorporated in and constitute a part of this specification, illustrate an embodiment of the invention and, together with the descriptions, serve to explain the principles of the invention.

In one exemplary embodiment, there may be provided a platform with at least one hole therein for the affixation of at least one attachment means to an underside of said platform. An ornament, figurine or decorative item may be mounted on the upper surface of such platform. On the underside of such platform may also be provided at least one integral metallic contact or magnet for adjoining such platform to at least one corresponding opposing polarity magnet on a generally rectangular base. Such base may consist of said at least one magnet and also include at least one receiving slot for the receipt of and internment of said attachment means within such base. Such receiving slot and corresponding attachment means may be oriented in any direction desired by the manufacturer provided they correspond with each other and allow for the internment of said attachment means within said slot when the ornament or other display item is mounted on said base.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1A:
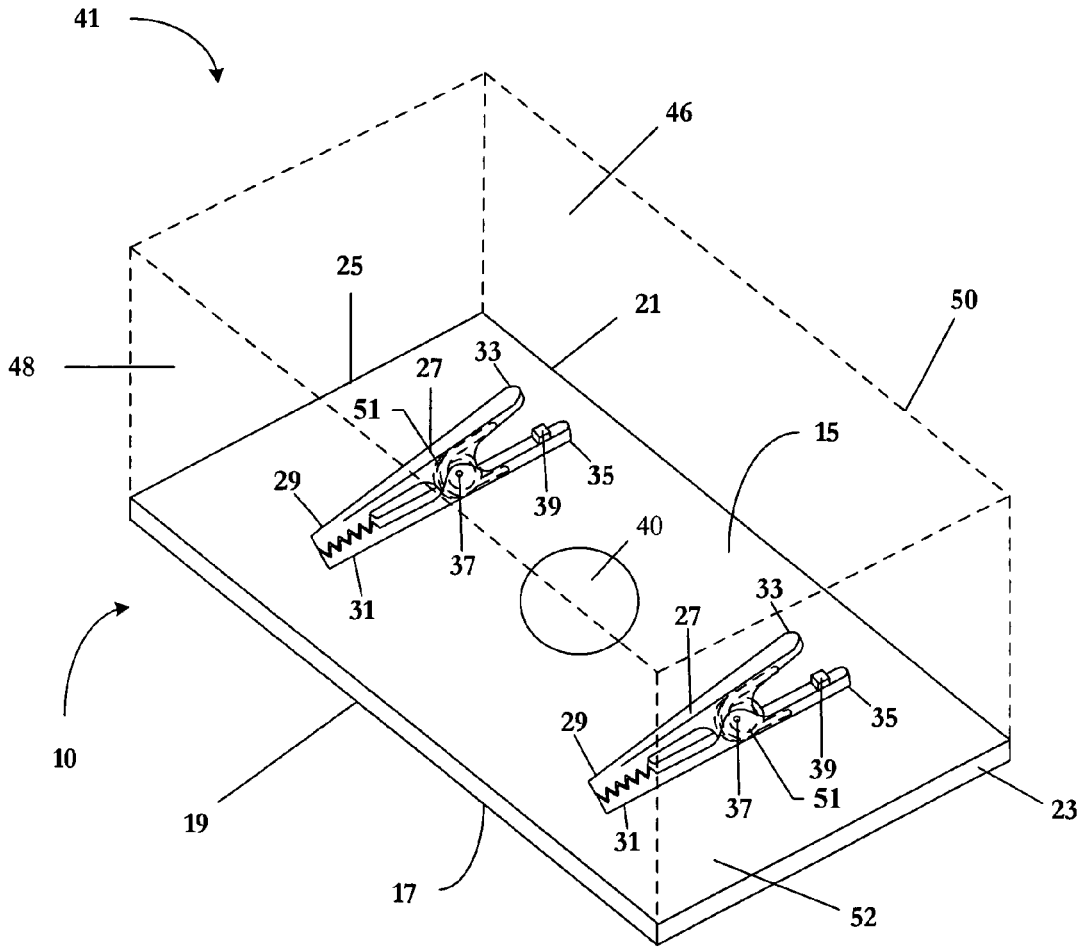
FIGS. 1A and 1B are exemplary perspective views of the platform and base of the present invention, in which the base is transparent for illustration purpose only and further depicting the underside of different embodiments of such exemplary platforms including at least one attachment means and at least one integral magnet.

Repeat use of reference characters throughout the present specification and appended drawings is intended to represent the same or analogous features or elements of the invention.

DETAILED DESCRIPTION OF THE PREFERRED EMBODIMENTS

Reference will now be made in detail to presently preferred embodiments of the invention, examples of which are fully represented in the accompanying drawings. Such examples are provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

Figure 1B:
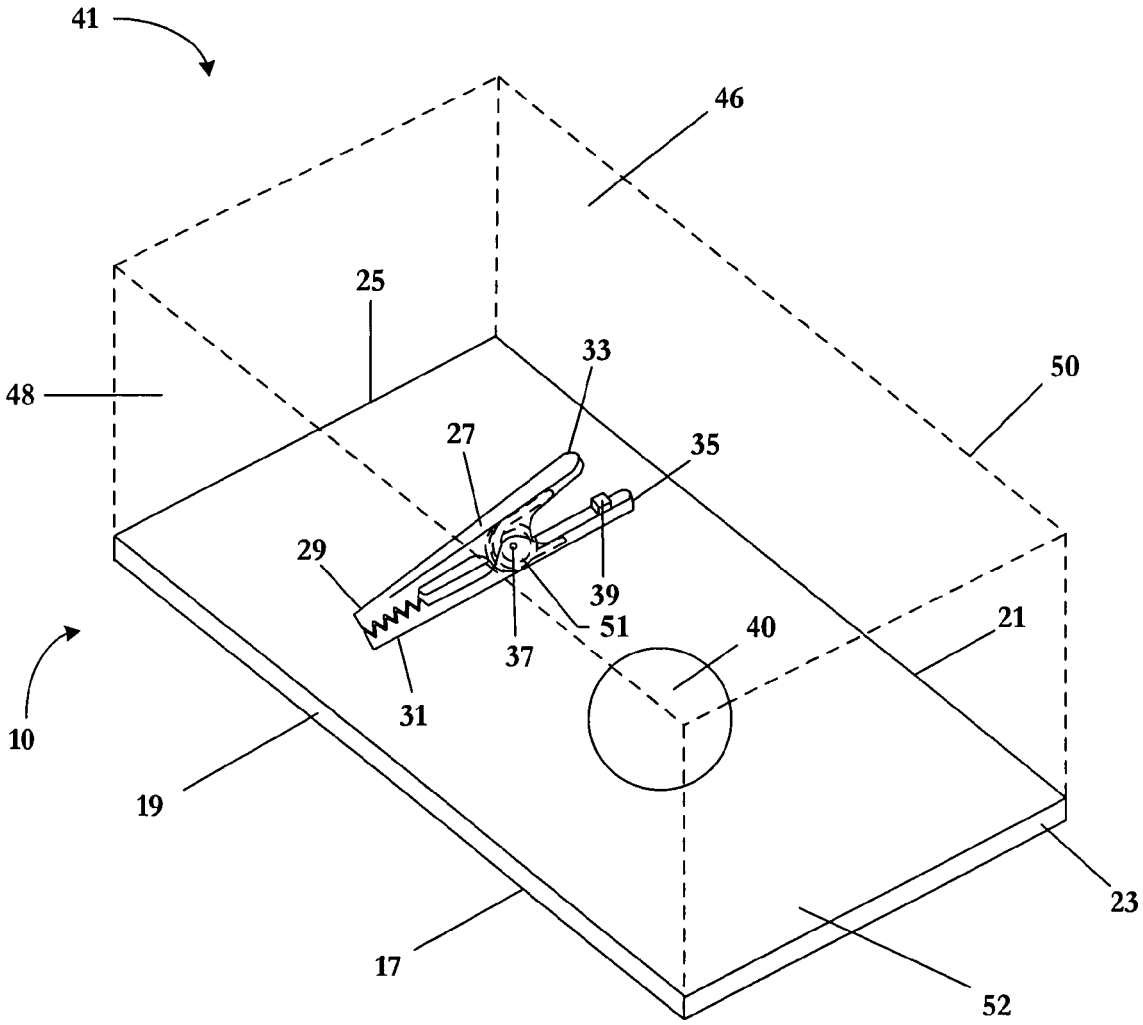

As disclosed above, the present invention is particularly concerned with a support assembly for displaying an ornament, figurine or decorative item. Two exemplary embodiments of such platforms 10 of the support assembly of the present invention are depicted in FIGS. 1A and 1B. Reference will be made to only the embodiment of FIG. 1A, but it should be noted that the embodiment of FIG. 1B merely demonstrated an embodiment including a difference in the number, location and orientation of attachment means 27 on such platform 10. Platform 10 has a generally flat bottom surface 15 and a generally flat top surface 17. It should be noted that while the platform is shown in a rectangular shape, it may have any useful or decorative shape. Platform 10 also has a front side 19, a back side 21, a first end 23 and a second end 25. Attached to bottom surface 15 are one or more attachment means 27 for attaching such platform to an irregular and generally horizontal projection.

Figure 2:
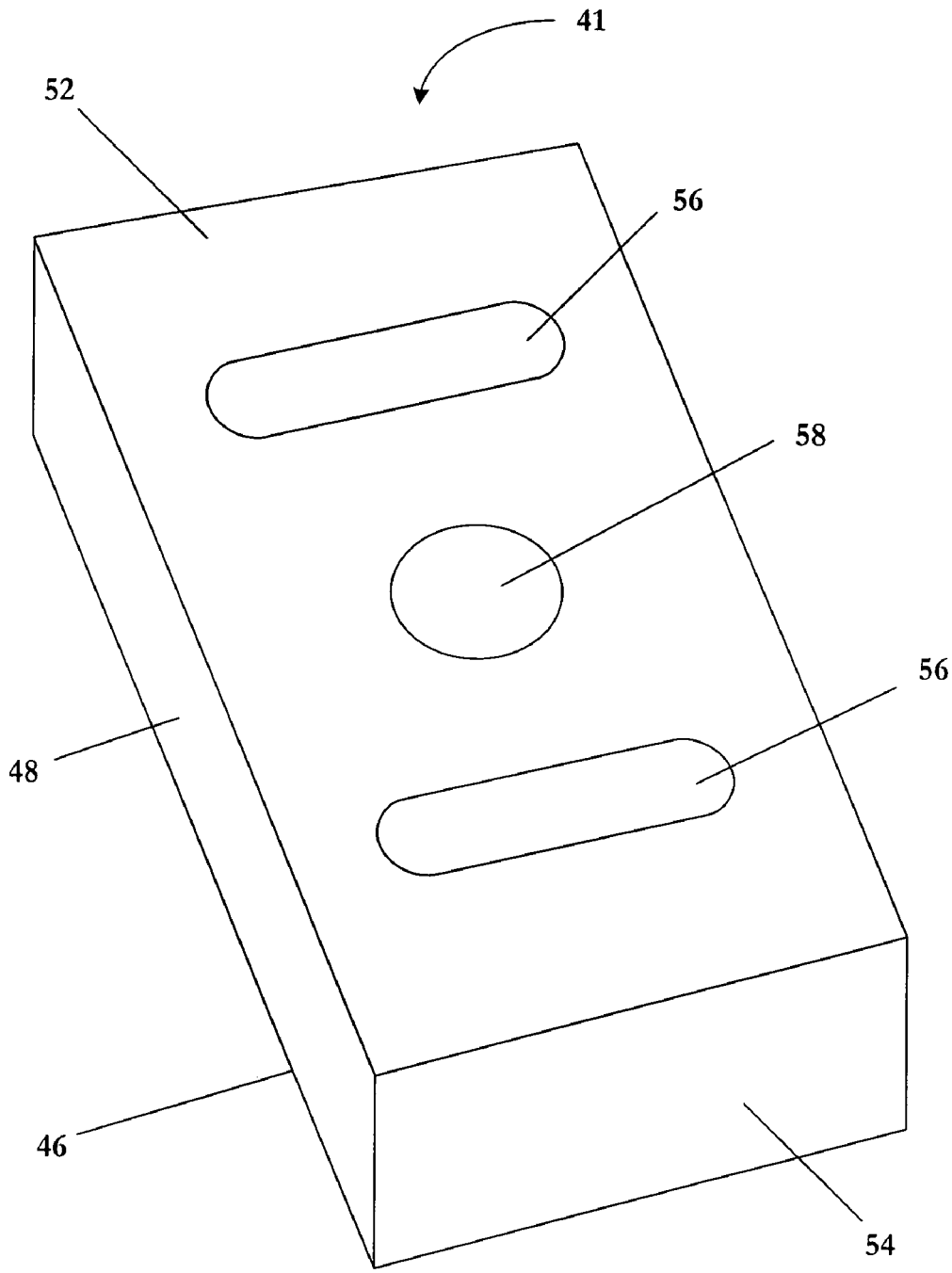
FIG. 2 is a perspective overhead view of an exemplary embodiment of a base member of the present invention including the receiving slot and an integral magnet.

FIG. 1A depicts an exemplary embodiment of the present invention having two attachment means, one adjacent said first end 23 and the other adjacent to said second end 25. Although two attachment means are shown, any number of such means may be employed that provide stability and ensure adequate attachment of the present invention to its support. Attachment means 27 has a first end and an opposite end, and has opposing jaw members 29, 31 on the first end of the clip, with jaw members 29, 31 being biased towards one another. The attachment means 27 may be oriented in any manner, including by way of example but not limitation, running from front to back of the platform or side to side or even at an angle. The only limitation on the orientation of the attachment means 27 is that they must correspond to slots provided in the base for their reception (as best seen in FIG. 2). Attachment means 27 also have legs 33, 35 on their opposite end from the jaw members. Jaw members 29, 31 are adjacent the front side 19 of said platform 10 and legs 33, 35 are adjacent the back side 21.

Figure 3:
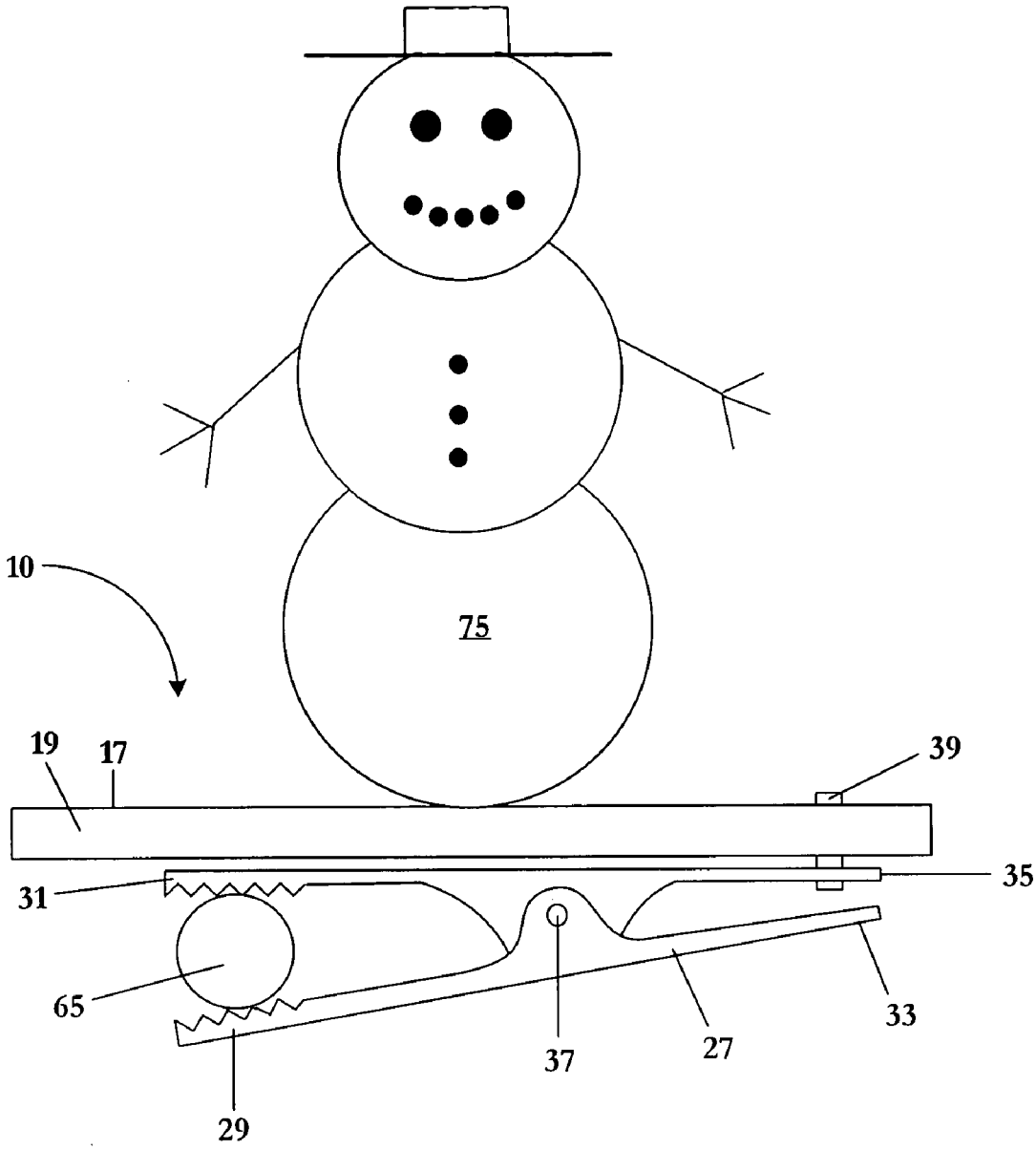
FIG. 3 is a side view of an exemplary embodiment of the platform of the present invention with an ornament on its upper surface and depicting an attachment means fastening such platform to a generally horizontal projection.
Figure 4:
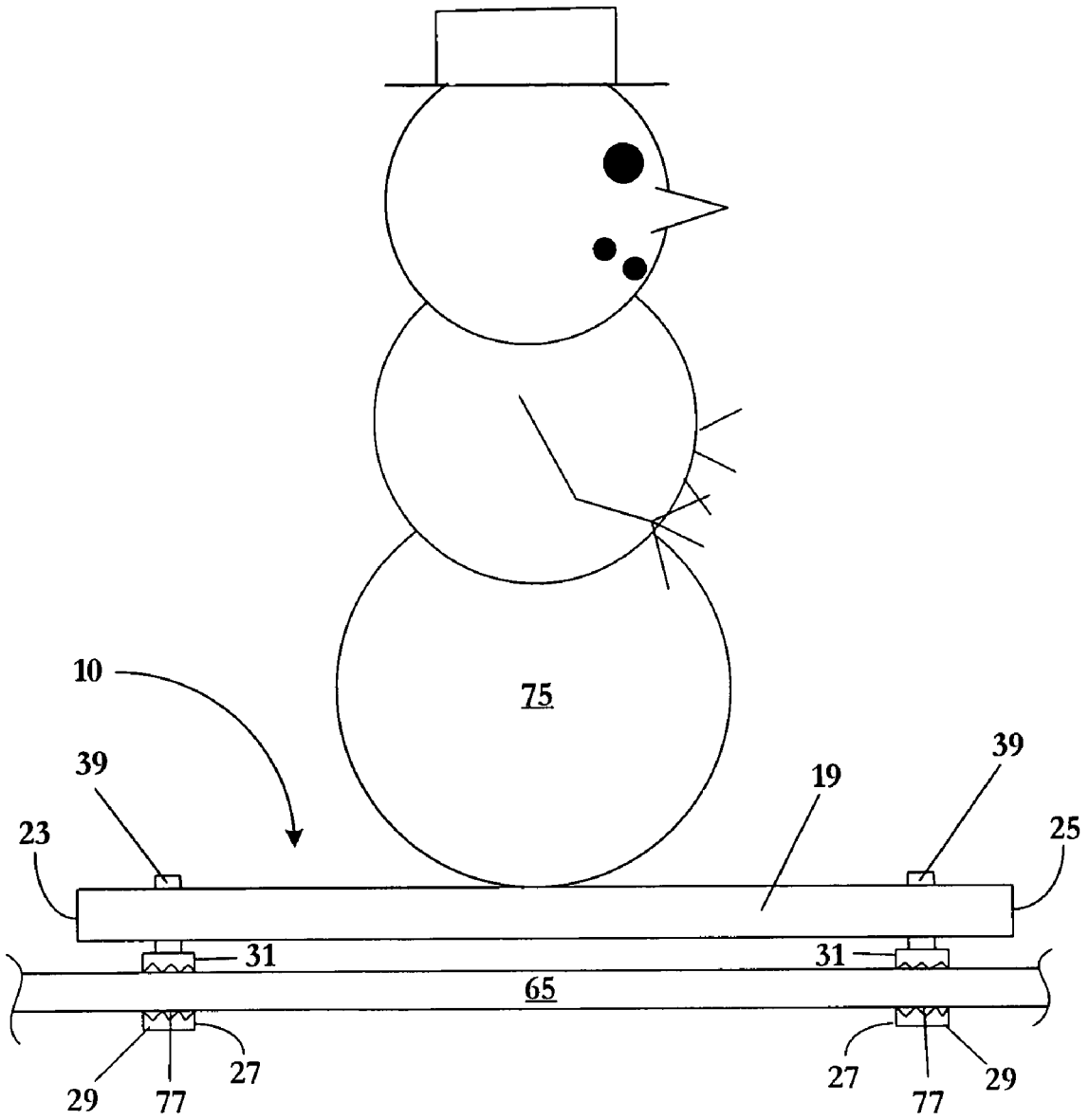
FIG. 4 is a front view of the exemplary embodiment of the platform depicted in FIG. 3 fastened to a horizontal projection by the attachment means.

Jaw members 29, 31 are connected by a pivot pin 37. A torsional spring 51 surrounds pivot pin 37 and biases the jaws to the illustrated closed position. Leg 35 (adjacent bottom surface 15) is secured to bottom surface 15 by fastening means 39. Fastening means 39 may include, but are not limited to, screws, bolts, rivets, glue, adhesive, and the like. As depicted in FIGS. 1, 3 and 4, one exemplary embodiment of the attachment means 27 includes an alligator clip. Such clip 27 is fastened to the bottom surface 15 of platform 10 with a screw, as fastening means 39. Such screw 39 fastens the clip 27 to the platform 10 through a hole in leg 35. The screw 39 may be attached from either the upper surface 17 or from the bottom surface 15 of the platform 10 and may be recessed so as to preserve the decorative appearance of the display. The platform 10 may be secured to the base 41 using a magnetic or metal contact 40 on the platform 10 and a corresponding opposing polarity magnet on the base 41.

Platform 10 is removable from base 41 of the present invention. As best seen in FIG. 2, base 41 has a flat bottom surface 46, a front side 48, a back side 50, a first end 52 and a second end 54. In one exemplary embodiment of the present invention, a plurality of attachment means 27, including, but not limited to alligator clips, are adapted to provide the relatively large force necessary to hold the platform in position on a generally horizontal projection to support and display an ornament, figurine or decorative item 75.

FIG. 2 illustrates an overhead perspective view of the base 41 of the present invention with the platform 10 removed. Attachment means 27 are housed in one or more receiving slots 56 while platform 10 is resting on top of base 41. While two receiving slots 56 are shown, any number of such slots may be utilized in the present invention provided they equal or exceed the number of attachment means 27. Further, such receiving slots 56 must be identically oriented as their corresponding attachment means 27 for proper mating of the platform 10 and the base 41. Contact 40 (FIGS. 1A & 1B) attaches to opposing polarity magnet 58 while platform 10 is resting on top of base 41 to further secure their attachment.

FIGS. 3 and 4 best illustrates a side and front view of platform 10 as mounted on a horizontal projection 65 with jaw members 29, 31 engaging horizontal projection 65 to secure said platform 10 and its ornament, figurine or decorative item 75 thereto. In the presently depicted exemplary embodiment, squeezing leg 33 towards leg 35 of attachment means 27 separates jaw members 29, 31 to permit a horizontal projection 65, such as a Christmas tree branch, to be placed therebetween. Upon releasing legs 33, 35 of attachment means 27, jaw members 29, 31 grasp horizontal projection 65 such that the platform 10 remains in position mounted on horizontal projection 65 without rotating about such projection 65.

With platform 10 so mounted, an ornament, figurine or decorative item 75 may be displayed on top surface 17 of platform 10 and be supported without having to be suspended from a top portion of such ornament, figurine or decorative item 75. An ornament, figurine or decorative item 75 may be positioned on top surface 17 unattached, or permanently attached or even reversibly attached by means well known in the art. When platform 10 is attached to the base 41 of the present invention, attachment means 27 are entombed within receiving slots/holes 56 and the ornament, figurine or decorative item 75 is provided with a generally flat surface upon which it may rest. As a result, such ornament, figurine or decorative item 75 may be displayed on a table, fireplace mantle or other generally flat surface without removing it from said platform 10.

FIG. 4 illustrates a front view of platform 10 positioned on a horizontal projection 65 which is being grasped by jaw members 29, 31 of attachment means 27. This view illustrates that in the presently depicted exemplary embodiment, jaw members 29, 31 have teeth members 77 which may penetrate horizontal projection 65 and prevent platform 10 from rotating about such horizontal projection 65. Although teeth members 77 are depicted in the present exemplary embodiment, other frictional means may be used including, but not limited to, ridges, grainy surfaces, adhesives, knife edges, and the like. In the present exemplary embodiment platform 10 is constructed of wood, but may also be constructed of without limitation glass, metals, plastics, other suitable materials or combinations thereof. Although platform 10, bottom surface 15, and top surface 17 are shown as flat, a variety of shapes may be used such as, for example, a concave surface, lip-like or fence-like projections, or mounting posts and the like. Similarly, some of these alternative surface shapes may be used to aid in aligning and/or attaching platform 10 to base 41.

With regard to the above detailed description of the present invention, it should be noted that the optimum dimensional relationships for the parts of the invention, including variations in size, materials, shape, form, function, and manner of operation, assembly and use, are readily apparent and obvious to one skilled in the art, and all equivalent relationships to those illustrated in the drawings and described in the specification are intended to be encompassed by the present invention. Thus, the foregoing is considered as illustrative only of the principles of the invention. In addition, since numerous modifications and changes will readily occur to those skilled in the art, the invention is not limited to the exact construction and operation shown and described, and accordingly, all suitable modifications and equivalents may be resorted to, failing within the scope of the invention as set forth in the following claims.

What is claimed is:

1. An apparatus for supporting and displaying an object comprising:

a) a platform having a top surface and a bottom surface adapted for supporting said object upon said top surface;

b) at least one attachment means attached to said bottom surface for interacting with a generally horizontal projection upon which said object is displayed; and c) an integral contact in said bottom surface of said platform for magnetically securing said platform to a base having a corresponding contact.

2. An apparatus according to claim 1 wherein said at least one attachment means is removably attached to said bottom surface of said platform.

3. An apparatus according to claim 1 wherein each of said at least one attachment means has a first end and an second end, wherein said first end of each of said at least one attachment means comprises opposite, opposing jaw members biased towards one another and wherein said second end of each of said at least one attachment means comprises legs that when forced together separate said opposite, opposing jaw members.

4. An apparatus according to claim 3 wherein said jaw members of each of said at least one attachment means are connected by a pivot pin and are biased towards one another by a torsional spring.

5. An apparatus according to claim 3 wherein said jaw members contain penetrating or frictional means to prevent said platform from rotating about said generally horizontal projection.

6. An apparatus according to claim 5 wherein the penetrating means are teeth.

7. An apparatus according to claim 1 wherein said at least one attachment means is an alligator clip.

8. An apparatus for supporting and displaying an object comprising:

a) a platform having a top surface and bottom surface, said top surface being adapted for supporting said object, and said bottom surface having an integral metal contact;

b) at least one attachment means removably affixed to said bottom surface of said platform and oriented thereon to permit attachment of said platform to a horizontal projection such that said top surface is positioned generally upright; and c) a base for supporting said platform having a top surface with an integral magnet to secure said platform to secure said platform to said base and a number of voids disposed within said top surface corresponding to the number and position of said attachment means and dimensioned to receive said attachment means within said base when said bottom surface of said platform rests on the top surface of said base.

9. An apparatus for supporting and displaying an object alternatively on an generally horizontal projection or a generally flat horizontal surface, said apparatus comprising:

a) a platform having a top surface, a bottom surface, and a metal contact, wherein said top surface is adapted for supporting said object for display;

b) at least one attachment means removably attached to said bottom surface of said platform, wherein each of said at least one attachment means has a first end and an second end, wherein said first end of each of said at least one attachment means comprises opposite, opposing jaw members biased towards one another and wherein said second end of each of said at least one attachment means comprises legs that when forced together separate said opposite, opposing jaw members and wherein said jaw members of each of said at least one attachment means are connected by a pivot pin and are biased towards one another by a torsional spring;

c) wherein said jaw members of each of said at least one attachment means further comprise penetrating or frictional means for preventing the rotation of said platform about said generally horizontal projection; and d) a base having a top surface and a number of receiving slots disposed therein corresponding to the number and orientation of said attachment means on said platform for receiving said attachment means within said base when said platform rests on the top surface of said base.

10. A display base for supporting an ornament display platform, said platform having clip means affixed to an underside thereof operable to attach said platform to a horizontal projection such that a top side of said platform remains upright, said base comprising a top surface for supporting said platform having voids therein corresponding to the number and position of said clip means and shaped to receive said clip means therein and an integral magnet for magnetically securing said platform upon said base.

11. A display base for supporting an ornament display platform, said platform having clip means affixed to an underside thereof operable to attach said platform to a horizontal projection such that a top side of said platform remains upright, said base comprising a top surface for supporting said platform having voids therein corresponding to the number and position of said clip means and shaped to receive said clip means therein wherein said platform further comprises an integral magnet for magnetically securing said platform upon said base.

* * * * *